United States Patent [19]

Küpfer et al.

[11] 4,014,664

[45] Mar. 29, 1977

[54] REACTOR FOR THE PRESSURE GASIFICATION OF COAL

[75] Inventors: Hans Küpfer; Paul Lange, both of Frankfurt am Main; Paul Rudolph, Bad Homburg, all of Germany

[73] Assignee: Metallgesellschaft Aktiengesellschaft, Frankfurt am Main, Germany

[22] Filed: Oct. 10, 1975

[21] Appl. No.: 622,182

[30] Foreign Application Priority Data

June 3, 1975 Germany ..... 2524445

[52] U.S. Cl. ..... 48/63; 48/68; 110/36; 126/182

[51] Int. Cl.[2] ..... C10J 3/16; C10J 3/42

[58] Field of Search ..... 48/68, 66, 67, 63, 77, 48/76; 110/36; 126/182

[56] References Cited

UNITED STATES PATENTS

| | | | |
|---|---|---|---|
| 399,798 | 3/1889 | Taylor | 48/68 |
| 1,527,879 | 2/1925 | Koller | 48/66 |
| 2,689,786 | 9/1954 | Hubmann | 48/77 |

*Primary Examiner*—Robert L. Lindsay, Jr.
*Assistant Examiner*—George C. Yeung
*Attorney, Agent, or Firm*—Burgess, Dinklage & Sprung

[57] ABSTRACT

A reactor for the pressure gasification of coal by treatment with oxygen and steam and, if desired, additional gasifying agents, at elevated temperatures and pressures, includes a water-cooled jacket and a rotary grate for moving the material to be gasified and for distributing the gasifying agents introduced into the reactor. The rotary grate is made of at least two concentric parts each of which rotates independly of the other part.

5 Claims, 3 Drawing Figures

REACTOR FOR THE PRESSURE GASIFICATION OF COAL

BACKGROUND

This invention relates to a reactor for the pressure gasification of coal by a treatment with oxygen and water vapour and, if desired, additional gasifying agents at elevated temperatures and under pressures of 5–100 bars, comprising a water-cooled jacket and a rotary grate for moving the material to be gasified and for distributing the gasifying agents introduced into the reactor.

Printed German Specification 1,021,116 discloses a reactor which serves for the pressure gasification of coal and comprises a water-cooled pressure housing, which is provided in its upper portion with an inlet lock and a distributor for the coal to be gasified. The gas producer is provided at its lower end with a rotary grate, which serves to receive and distribute the gasifying agents and to discharge the ash which has been formed. The ash which is discharged by the grate from the reactor shaft is subjected to preliminary disintegration in a crusher and is withdrawn through an ash lock.

Gasification is effected in such reactors at temperatures up to above 800° C. Air or oxygen-enriched air are often used and pure oxygen is sometimes used as a gasifying agent having an oxidizing activity. Water vapor is used in most cases as a gasifying agent having a reducing activity, which is also required. Carbon monoxide may be used as a further gasifying agent.

To ensure a good gasification performance, a high output and a high efficiency of the pressure gasification reactor, the fuel must be distributed as uniformly as possible throughout the cross-section of the reactor and the entire fuel bed must descend as uniformly as possible. A lead or lag of the fuel at one point or at more points will result in a distortion of the various zones of the material being gasified so that there is only a low degree of combustion. In that case the grate may be endangered by high ash temperatures. Besides, the bed of the material to be gasified may burn through, particularly at the edge of the reactor, so that valuable gases which have been produced may burn with residual oxygen at the edge of the fuel bed or above the same and deflagration may occur.

In pressure gasification reactors of the usual type, the fuel bed rests substantially on a rotary grate, such as is shown in Opened German Specification 2,346,833. The reactors are operated at a fuel rate of 5000–6000 kg/m²-h. This high throughput necessitates the provision of a large area for the supply of the gasifying agents because excessively high local temperatures resulting in a rapid sintering or fusing of the ash can be prevented only in this way. The throughput rate required for a pressure gasification reactor is about forty times the throughput rate of a normal gas producer operating under atmospheric pressure.

When the rotary grate is started, the masses of fuel lying on the grate give rise to strong forces. On the other hand, the peripheral zones of the fuel bed which are not disposed directly over the rotary grate are subjected only to the force of gravity for their descent and the action of said force is opposed by the wall friction. For this reason the velocity at which the fuel bed descends at the edge of the reactor is only about 60–80 % of the mean velocity of the descent of the fuel bed as a whole. As the speed of the grate increases, the central portions of the fuel column are preferentially moved and discharged.

Because the pressure gasification reactors have a water-cooled jacket, the fuel near the periphery has not only a larger void ratio but owing to the lower temperatures presents also a lower resistance to the flow of the rising gases than the central portion of the fuel column. As a result, the ash bed quickly grows upwardly in the peripheral zones, and the gases having a high calorific value which leave the central portion of the fuel bed are diluted by gases having a low calorific value from the peripheral portions.

The irregular descent of the fuel column is accompanied by a loss in output because the peripheral fuel portions can be gasified only at a reduced rate. These peripheral fuel portions constitute a major portion of the quantity of the fuel bed.

It has already been attempted to provide a grate which is specially shaped so as to reduce the preferential descent of the central fuel portion. These measures have not given the desired results, for instance, because flights provided on the grate wear off quickly. The movement of the fuel and the distribution of the ash may also be corrected by controlling the feeding of the fuel so as to provide a fuel bed having portions of different height. These measures are highly dependent on the nature of the fuel which is employed and often involve other disadvantages. For instance, the feeding of more closely packed fuel to the peripheral portion of the reactor may have the result that the central portion is too highly permeable to gas temporarily and the fuel burns through in this area. For these reasons, the measures which have been described can be successful only in part and even this success is questionable and depends on the kind of fuel, the particle size distribution of the fuel, the throughput rate of the gas producer and its load conditions. Particularly for caking coals the measures which have been described do not constitute a satisfactory solution. Caking coals cannot be successfully gasified unless all fuel particles are heated up at a uniform rate.

SUMMARY

This invention eliminates the above-mentioned disadvantages and ensures that the fuel column descends uniformly under widely varying operating conditions. This is accomplished according to the invention in that the grate consists of at least two concentric parts, which are rotatable independently of each other. In such an arrangement, the inner part or parts of the grate may be used to distribute the gasifying agents and the outer part of the grate may be used to discharge the ash independently of the inner parts of the grate.

DESCRIPTION

The use of a grate which consists of two or more parts enables the different parts of the grate to be driven at different speeds. The inner part or parts of the grate rotate at a relatively low speed so that irregularities in the feeding of gasifying agents are equalized. The outer part of the grate serves to discharge the ash and is usually driven at a somewhat higher speed.

The parts of the grate are driven by different motors, which are controlled in speed. As a result, each part of the grate can be independently controlled between standstill and the highest speed which may be required. The outer part of the grate may be rotated at a higher speed to accelerate the movement and the rate of descent of the peripheral zones of the fuel bed so that said peripheral zones keep up with the descent of the central portions of the fuel. This mode of operation results in a uniform movement of the fuel throughout the cross-section of the reactor.

The grate designed according to the invention improves also the start-up of a pressure gasification reactor. Initially, only the outer part of the grate may be driven to move the fuel column initially from the outside whereas the inner part or parts of the grate is or are initially left at a standstill. This mode of operation enables a sufficient covering of the grate with ash during the critical start-up so that a burning of the grate can be avoided. During start-up this mode of operation has also the advantage that much smaller forces are required to start the grate. If the entire grate of the reactor were started at once, the static friction between the fuel bed and the grate would have to be overcome throughout the cross-section during start-up. This would result in high starting torques so that very large and heavy drive means would be required. The use of a composite grate and the driving of only the outer part of the grate at the beginning result in much smaller forces. This mode of operation enables also a faster start-up of the pressure gasification reactor because a slagging and burning-through in the peripheral zones during a great load increase can be reliably prevented.

A major portion of the gasifying agents is fed into the reactor and uniformly distributed by means of the central part of the grate. For this purpose the grate is provided with feed conduits and apertures for the passage of the gasifying agents.

To improve the performance of the outer grate part and to ensure a more uniform discharge of ash, the inside surface of the reactor shell flares downwardly in conical shape at least adjacent to the grate. The angle of taper is 2°–4° from the vertical. As a result of this measure, the discharge zone is relieved and a uniform descent of all fuel layers approaching the discharge area is ensured. Advantageously, the outside diameter of the inner part of the grate is 0.5 to 0.8 times the inside diameter of the adjacent portion of the reactor.

The composite grate may be operated without a cooling of the grate because its operation may be controlled in such a manner that a sufficient covering of the grate with ash is always ensured. On the other hand, gasifying agent flows first through the interior of the grate before leaving the grate through the outlet openings. A sufficient cooling of the grate is thus accomplished. To protect the bearings for the grate parts from high temperatures, water vapor is caused to flow through such bearings at a low rate so that the bearings are cooled sufficiently to prevent a decomposition of the lubricant.

DESCRIPTION OF THE DRAWING

Features which may be adopted in the ractor will be explained with reference to the drawing, in which.

Figure 1:
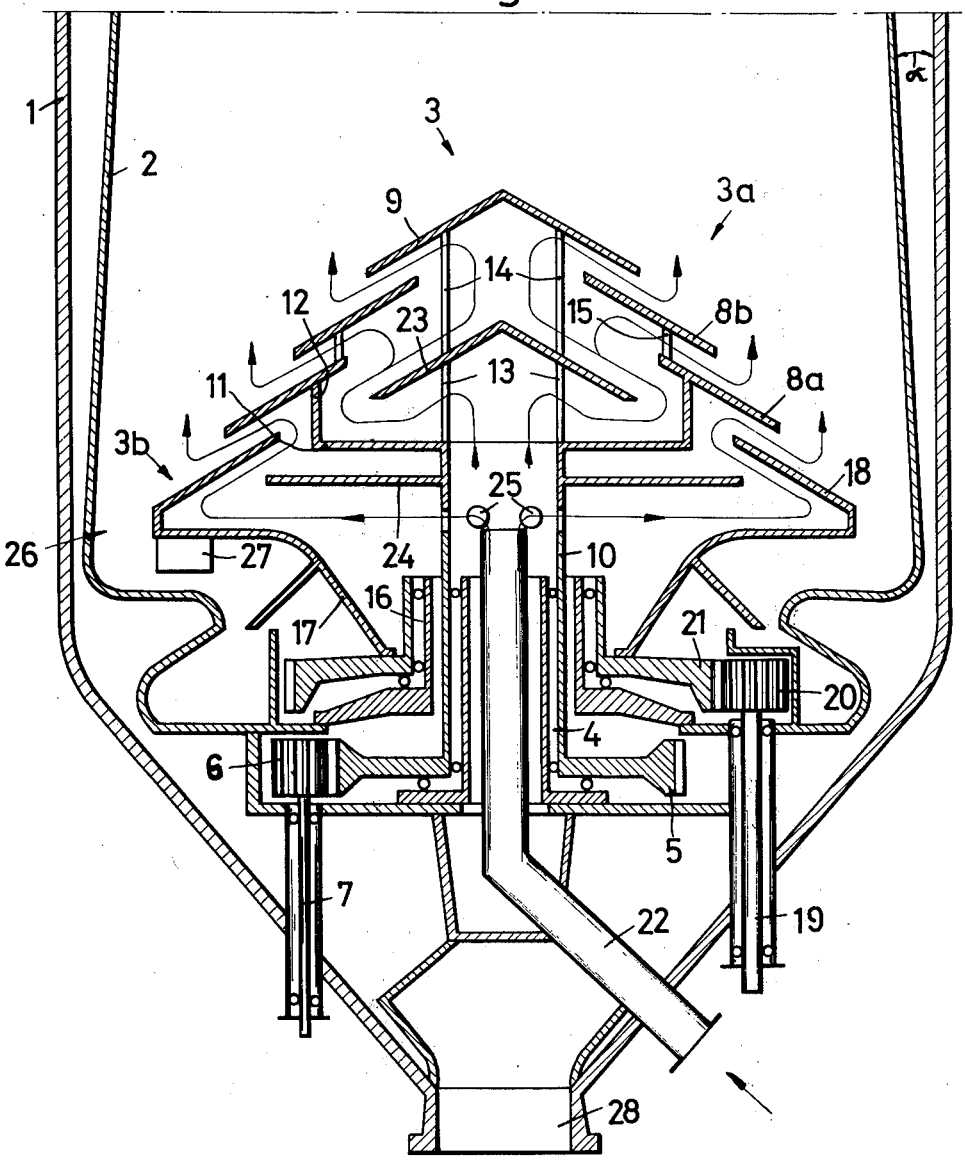
FIG. 1 is a longitudinal sectional view showing the lower portion of a pressure gasification reactor having a bipartite rotary grate.

The part of the pressure gasification reactor which is shown in FIG. 1 comprises an outer shell 1 and an inner shell 2. Cooling water is disposed between the two shells. The water vapor produced as a result of the cooling may be introduced as gasifying agent into the reactor.

The lower part of the reactor contains a bipartite rotary grate 3, which has approximately the shape of a cone when viewed from the outside. The inner part 3*a* of the grate is provided with a ball bearing 4, which is connected to a gear 5 in mesh with a pinion 6. The latter is connected to a drive shaft 7, which extends to an electric motor, not shown.

The outside portions of the inner part 3*a* of the grate consist of overlapping parts 8*a* and 8*b* having the shape of parts of the periphery of a cone, and of a part 9 having the shape of the apex of a cone. These parts are connected to the bearing 4 by the cylindrical carrying part 10 and additional carrying elements 11 to 15. The elements 13 to 15 consist of individual struts.

The outer part 3*b* of the grate comprises a ball bearing 16, to which a funnel-shaped carrying bowl 17 and an outer portion 18 having the shape of the periphery of a cone are connected. Part of the outer portion 18 is covered by the conical portion 8*a* of the inner part of the grate. The outer part 3*b* of the grate is provided with separate drive means comprising an electric motor, not shown, for driving the shaft 18, which carries a pinion 20 in mesh with a gear 21, which is connected to the ball bearing 16.

Oxygen and water vapor used as gasifying agents are conducted through a pipe 22 into the interior of the grate and flow in the same as indicated by the flow arrows shown in FIG. 1. The gasifying agents are guided in such a manner that they flow as far as possible in contact with the inside surfaces of all portions of the grate which are contacted by the hot environment of the grate so that said portions are cooled. Partial streams of the gasifying agents flow out through spaces between adjacent conical portions 8*a*, 8*b* and the apex portion 9 as well as through the area in which the two parts 3*a* and 3*b* overlap. These partial streams then enter the material to be gasified, which is disposed over the grate. Baffles 23 and 24 are provided to ensure that the gasifying agents will be distributed as uniformly as possible even in the interior of the grate. The gasifying agents flow through apertures 25 in the cylindrical carrying member 10 into the space between the two parts 3*a* and 3*b* of the grate. It is readily apparent from the drawing that the arrangement of the baffles 23 and 24 and of the various passage openings can be selected so as to control the flow of the gasifying agents in the desired manner and to cause them to emerge from the grate at desired locations and with a predetermined intensity.

The coal bed over the grate 3 is not shown. The rotation of the two parts 3*a* and 3*b* of the grate assists the movement of the ash formed in the coal bed during the gasification process toward the annular opening 26, where one or more scrapers 27 are provided to discharge the ash out of the gasification area. The ash then drops and is removed through the outlet 28 in known manner by means of an ash lock, which is not shown in detail.

The two parts 3*a* and 3*b* of the grate are rotatable independently of each other and ensure that all portions of the fuel column lying over the grate 3 descend at a uniform rate. In most cases the grate provided according to the invention will be operated so that the angular velocity of the outer part 3*b* of the grate exceeds that of the inner part 3*a* of the grate. The shape of the inner shell 2 contributes to the uniformity of the descent in the reactor. The inner shell 2 flares downwardly in conical shape adjacent to the grate to contribute to the uniformity of the descent in the reactor. The angle of taper $\alpha$ between the conical shell 2 and the vertical is 2°–4° adjacent to the grate. As a result of this taper, the inside cross-sectional area of the reactor increases downwardly so that the relative movements of the fuel and ash particles are reduced in speed and rendered more uniform. This design of the reactor and the use of a composite grate results in a gasifying operation which is much less problematic then has been possible before.

Figure 2:
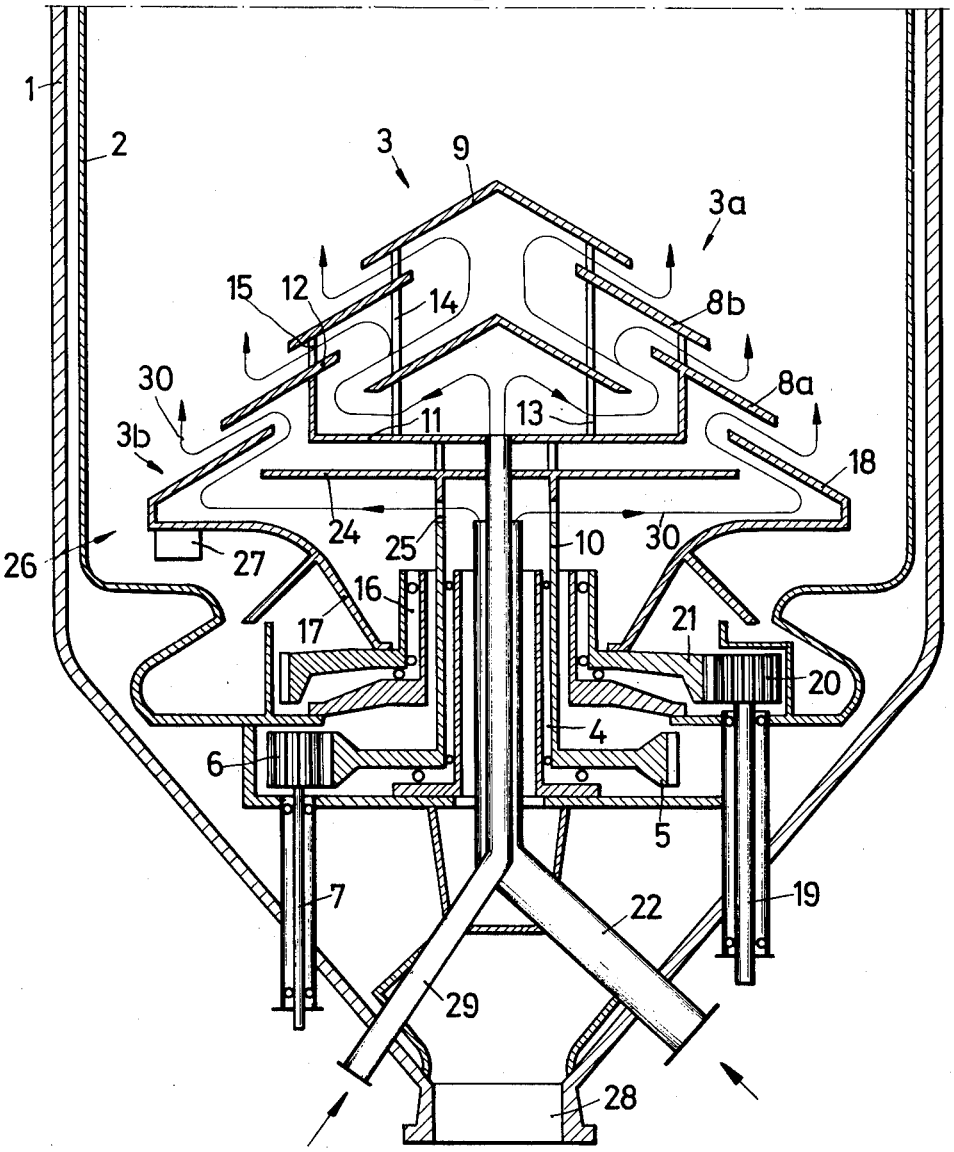
FIGS. 2 and 3 show additional features of the reactor of FIG. 1.
Figure 3:
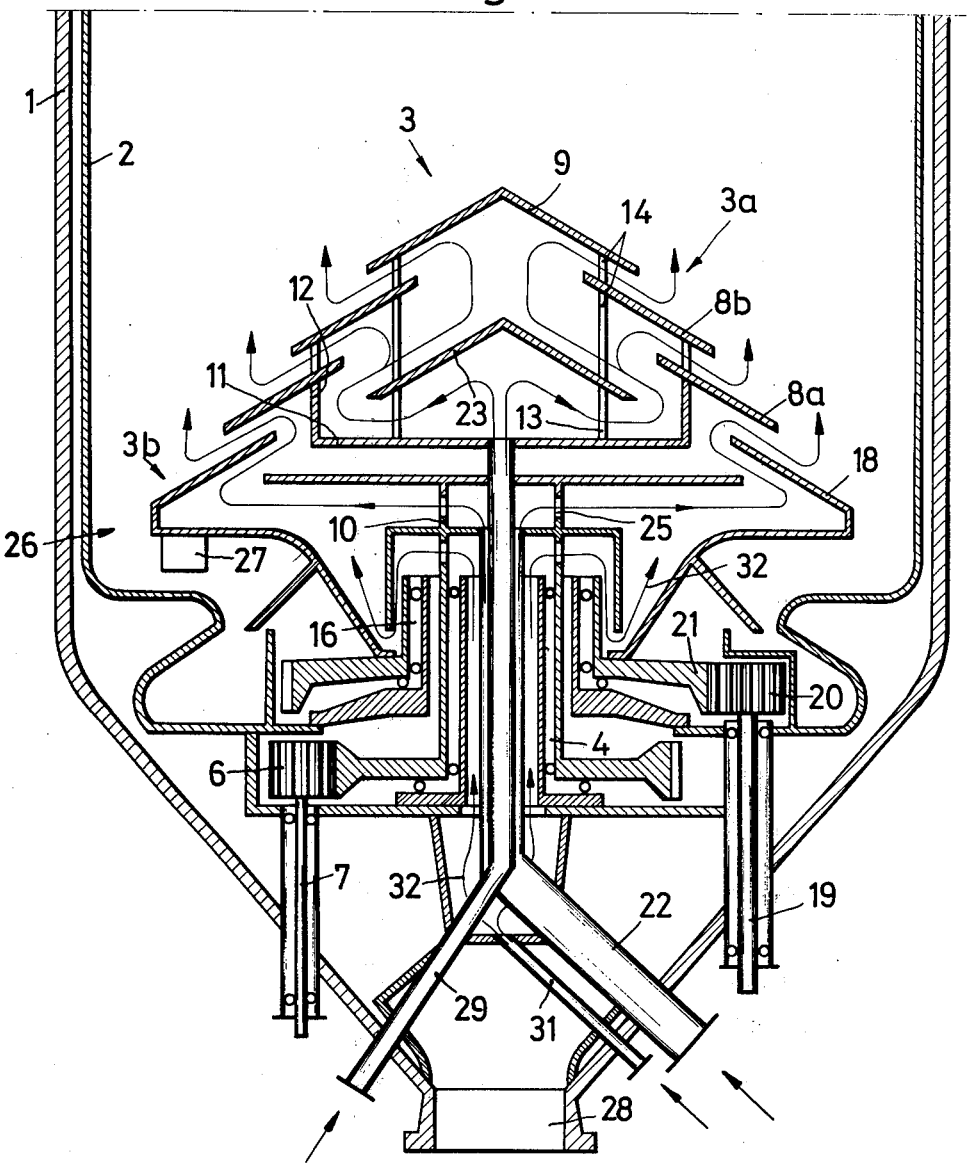

FIGS. 2 and 3 are in basic agreement with the reactor of FIG. 1. For this reason, like parts having like modes of operation have the same reference characters. Reference can be made to FIG. 1 for a more detail explanation of these similar parts. In FIGS. 2 and 3 the inner shell 2 has adjacent to the grate 3 a uniform cylindrical shape rather than a conical shape. It will be understood that the inner shell 2 of FIG. 1 may be cylindrical and the inner shell of FIGS. 2 and 3 may be conical.

The embodiment shown in FIG. 2 comprises a pipe 22 for feeding gasifying agent and a second pipe 29 for gasifying agent. The gasifying agent from pipe 29 flows through the inner part *3a* of the grate and into the reactor. The gasifying agent conducted in the pipe 22 flows out along the flow arrows 30 only in the space between the inner part *3a* and the outer part *3b* of the grate. Gasifying agents of different compositions may be fed into the reactor through the two conduits.

The embodiment shown in FIG. 3 differs from that of FIG. 2 by the provision of an additional conduit 31, through which water is fed which serves particularly to flush the two ball bearings 4 and 16. The water vapor atmosphere in which the two ball bearings are maintained serves to cool the ball bearings and prevents an oxidative decomposition of the lubricant. In addition to the water vapor which enters the reactor through the bearings 4 and 16, water vapor flows along the arrows 32 through the space between the two parts *3a* and *3b* of the grate into the fuel bed.

EXAMPLE 1

A reactor as shown in FIG. 1 was used for the pressure gasification of coal and had adjacent to the grate a largest inside diameter of 4.68. The reactor had an inside height of 5.3 m and an angle of taper $\alpha$ of 2°. The reactor was provided with a bipartite grate having the following dimensions: Overall height: 3m; diameter of the inner part of the grate: 3.3 m; diameter of the outer part of the grate: 4.08 m. Pit coal having a particle size range of 5–30 mm and an ash content of 35 % by weight was gasified in the reactor under a pressure of 27 bars at a rate of 82 metric tons per hour. Gasifying agent consisting of a mixture of water vapor and oxygen was introduced into the reactor through the grate at a rate of 114,000 kg/h. The ratio of water vapor to oxygen amounted to 5.5 kg/standard $m^3$. During start-up, the outer part of the grate was rotated at 4 revolutions per hour and the inner part of the grate was at a standstill. During continuous operation, the inner part of the grate performed 3 revolutions per hour and the outer part of the grate performed 10 revolutions per hour. The gasification involved no problems during start-up and during continuous operation.

EXAMPLE 2

A reactor as shown in FIG. 2 was used for the same purpose as the reactor of Example 1. The reactor had a cylindrical inner shell which was 4.68 m in diameter. The reactor had an inside height of 5.3 m and contained the bipartite rotary grate which has been described in Example 1. Gasifying agent streams having equal flow rates were fed into the reactor through the inner part of the grate and through the space between the inner and outer parts of the grate. The ratio of water vapor to oxygen was 6.2 kg/standard $m^3$ in the gasifying agent conduit 22 and 3.8 kg/standard $m^3$ in conduit 29. It has been found that this reactor may also be used with good results for a pressure gasification of coal in continuous operation.

EXAMPLE 3

The reactor shown in FIG. 3 is similar to that used in Example 2 and is additionally provided with a water vapor trap for the two bearings 4 and 16. The reactor was also tested in the gasifying operation of Example 2. The water vapor trap was fed through conduit 31 with 2000 kg water vapor per hour. The gasification results were basically the same as in the preceding two examples.

What is claimed is:

1. A closed reactor for the gasification of coal with oxygen and water vapor as gasifying agents at elevated temperature and under pressures of 5 – 100 bars, comprising water-cooled jacket means, said jacket means defining an inner shell surrounding the gasification zone of the reactor, rotary grate means in said gasification zone for moving the material to be gasified, an ash lock beneath said rotary grate means for receiving ash remaining from the material after gasification, said rotary grate means being provided with feed conduits for receiving gasifying agents and with apertures for the passage of the gasifying agents into the gasifying zone, said rotary grate means being composed of two concentric parts, driving means for rotating each grate part independently of the other, the outer diameter of the inner part of the grate being 0.5 to 0.8 times the inside diameter of the inner shell adjacent to the rotary grate means, and scraping means attached to the outer part of said rotary means the movement of the grate parts assisting the movement of ash formed upon gasification, the rotation of the scraping means with the outer grate part scraping ash from inside the reactor to the ash lock.

2. Reactor of claim 1 wherein the inner part of the grate means defining chambers provided with outlet openings for the gasifying agent.

3. Reactor of claim 1, including means defining outlet openings for gasifying agents provided between the two concentric parts of the grate means.

4. Reactor of claim 1 wherein the parts of the two concentric grate means have bearings through which steam can be circulated.

5. Reactor of claim 1 wherein the inside surface of the inner shell of the reactor flares downwardly in conical shape at an angle of 2°–4° from the vertical, at least adjacent to the grate means.

* * * * *

UNITED STATES PATENT AND TRADEMARK OFFICE

CERTIFICATE OF CORRECTION

PATENT NO. : 4,014,664 Page 1 of 1

DATED : March 29, 1977

INVENTOR(S) : Hans Kupfer et al

It is certified that error appears in the above-identified patent and that said Letters Patent are hereby corrected as shown below:

Claim 1

Col. 6, line 48 before "means" insert -- grate --

Claim 1

Col. 6, line 48 after "means" insert -- , --

Signed and Sealed this twenty-third Day of August 1977

[SEAL]

*Attest:*

RUTH C. MASON
*Attesting Officer*

C. MARSHALL DANN
*Commissioner of Patents and Trademarks*